US010654702B2

(12) United States Patent
Kasprzycki et al.

(10) Patent No.: US 10,654,702 B2
(45) Date of Patent: May 19, 2020

(54) VALVE ASSEMBLIES AND MANUALLY OPERABLE HANDLE ASSEMBLIES FOR BEVERAGE DISPENSING MACHINES

(71) Applicant: Cornelius, Inc., Osseo, MN (US)

(72) Inventors: Tomasz K. Kasprzycki, Carpentersville, IL (US); Hansel Sjukur, Chicago, IL (US)

(73) Assignee: Cornelius, Inc., Osseo, MN (US)

( * ) Notice: Subject to any disclaimer, the term of this patent is extended or adjusted under 35 U.S.C. 154(b) by 0 days.

(21) Appl. No.: 16/227,407

(22) Filed: Dec. 20, 2018

(65) Prior Publication Data

US 2019/0194010 A1 Jun. 27, 2019

Related U.S. Application Data

(60) Provisional application No. 62/608,659, filed on Dec. 21, 2017.

(51) Int. Cl.

| | |
|---|---|
| ***B67D 1/12*** | (2006.01) |
| ***B67D 1/14*** | (2006.01) |
| ***B67D 1/00*** | (2006.01) |

(52) U.S. Cl.

CPC ..... *B67D 1/12* (2013.01); *B67D 1/0037* (2013.01); *B67D 1/0044* (2013.01); *B67D 1/14* (2013.01); *B67D 1/1477* (2013.01)

(58) Field of Classification Search

CPC ..... B67D 1/12; B67D 1/14; B67D 1/0021; B67D 1/0044; B67D 1/0082; B67D 1/0085; B67D 1/1277; B67D 1/1477; B67D 2001/0093; B67D 2001/0094

USPC ..... 222/129.1

See application file for complete search history.

(56) References Cited

U.S. PATENT DOCUMENTS

| | | | | |
|---|---|---|---|---|
| 3,112,656 A * | 12/1963 | Cary | B67D 1/0083 | 74/471 R |
| 3,667,724 A * | 6/1972 | Cornelius | B67D 1/0085 | 251/129.2 |
| 3,934,759 A | 1/1976 | Giannella et al. | | |
| 4,497,343 A * | 2/1985 | Brown | B67D 1/0084 | 137/614.06 |

(Continued)

OTHER PUBLICATIONS

International Search Report and Written Opinion, PCT/US2018/067007, dated Mar. 5, 2019.

*Primary Examiner* — Benjamin R Shaw

(74) *Attorney, Agent, or Firm* — Andrus Intellectual Property Law, LLP

(57) ABSTRACT

A beverage dispensing machine includes a valve body configured to receive a first fluid and a second fluid and dispense the first fluid through a first orifice and the second fluid through a second orifice. A first valve seal is movable to open and close the first orifice, and a second valve seal is movable to open and close the second orifice. An arm is pivotally coupled to the valve body, and pivoting of the arm relative to the valve body moves the first valve seal and the second valve seal and thereby opens the first orifice and the second orifice. The machine also includes a solenoid valve configured to pivot the arm, and a handle with a leg that is pivotable into and between a rest position in which the valve seals are closed and an active position in which the valve seals are open. As the handle moves from the rest position to the active position, the leg acts on the solenoid valve such that the arm pivots and the valve seals open.

19 Claims, 11 Drawing Sheets

(56) References Cited

U.S. PATENT DOCUMENTS 4,549,675 A * 10/1985 Austin ..... B67D 1/0082 137/607
4,741,355 A * 5/1988 Credle, Jr. ..... B67D 1/0044 137/269
4,884,720 A * 12/1989 Whigham ..... B67D 1/0037 222/54
4,899,911 A * 2/1990 Rohde ..... B67D 1/0001 222/103
5,129,549 A * 7/1992 Austin ..... B67D 1/0082 222/129.1
5,269,442 A * 12/1993 Vogel ..... B67D 1/0044 222/129.1
5,285,815 A 2/1994 Henry et al.
5,303,849 A * 4/1994 Credle, Jr. ..... B67D 1/0085 137/607
5,607,083 A 3/1997 Vogel et al.
5,845,815 A 12/1998 Vogel
6,058,986 A * 5/2000 Bethuy ..... B67D 1/1238 137/392
6,305,269 B1 * 10/2001 Stratton ..... B67D 1/0044 222/459
6,648,185 B1 * 11/2003 Henry ..... B67D 1/0085 141/351
2004/0000560 A1 * 1/2004 Henry ..... B67D 1/005 222/59
2004/0129724 A1 * 7/2004 Stratton ..... A47J 31/41 222/129.1
2005/0072799 A1 * 4/2005 Stratton ..... A47J 31/41 222/129.1
2009/0065529 A1 * 3/2009 Guadalupi ..... B67D 1/0021 222/129.1
2009/0095770 A1 * 4/2009 Newton ..... B67D 1/0082 222/129.1
2013/0062545 A1 * 3/2013 Sevcik ..... B67D 7/50 251/242
2015/0056096 A1 * 2/2015 Hoover ..... B67D 1/0044 422/24

* cited by examiner

VALVE ASSEMBLIES AND MANUALLY OPERABLE HANDLE ASSEMBLIES FOR BEVERAGE DISPENSING MACHINES

CROSS-REFERENCE TO RELATED APPLICATION

The present application is based on and claims priority to U.S. Provisional Patent Application No. 62/608,659 filed Dec. 21, 2017, the disclosure of which is incorporated herein by reference.

FIELD

The present disclosure relates to beverage dispensing machines having valve assemblies and manually operable valve assemblies.

BACKGROUND

The following U.S. Patents are incorporated herein by reference in entirety.

U.S. Pat. No. 5,269,442 discloses a nozzle for a post-mix beverage dispensing valve that optimizes flow of fluids. The nozzle includes a first diffuser plate followed by a central flow piece having a frusto-conical outer water flow surface and an interior syrup flow channel. Second and third diffuser plates follow the frusto-conical portion. The second and third diffuser plates have perimeter edges that contact the inner surface of a nozzle housing so that the carbonated water must flow through holes in the diffusers.

U.S. Pat. No. 5,607,083 discloses a post-mix beverage dispensing valve having a nozzle that provides for higher flow rates. The valve is designed to provide for an electronic switch/control module separate from the valve housing cover, and the valve includes improved banjo valves and accompanying seat structures to provide for increased fluid flow and for fluid flow that is less turbulent.

U.S. Pat. No. 5,845,815 discloses a piston based flow control for use in a high flow beverage dispensing valve. The piston includes a top perimeter edge structure that allows for continuity of fluid flow during high flow applications and particularly during the initiation of a high flow dispensing so as to eliminate chattering of the piston.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a beverage dispensing machine includes a valve body configured to receive a first fluid and a second fluid and dispense the first fluid through a first orifice and the second fluid through a second orifice. A first valve seal is movable to open and close the first orifice, and a second valve seal is movable to open and close the second orifice. An arm is pivotally coupled to the valve body, and pivoting of the arm relative to the valve body moves the first valve seal and the second valve seal and thereby opens the first orifice and the second orifice. The machine also includes a solenoid valve configured to pivot the arm, and a handle with a leg that is pivotable into and between a rest position in which the valve seals are closed and an active position in which the valve seals are open. As the handle moves from the rest position to the active position, the leg acts on the solenoid valve such that the arm pivots and the valve seals open.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

In the below description, certain terms have been used for brevity, clarity, and understanding. No unnecessary limitations are to be inferred therefrom beyond the requirement of the prior art because such terms are used for descriptive purposes and are intended to be broadly construed. The different apparatuses and systems described herein may be used alone or in combination with other apparatuses and systems. It is to be expected that various equivalents, alternatives, and modifications are possible within the scope of the appended claims.

The present inventor has recognized that consumers associate beverage dispensing machines having operable handle assemblies (e.g. pull handles) with high-quality beverages. That is, beverages dispensed from beverage dispensing machines having a pull handle are perceived to be of high quality and value. Accordingly, the present inventors have endeavored to create beverage dispensing machines with valves or valve assemblies and operable handle assemblies that permit an operator to dispense mixed beverages at various flow rates. Accordingly, the present inventors have invented the valve assemblies and handle assemblies disclosed herein.

Figure 1:
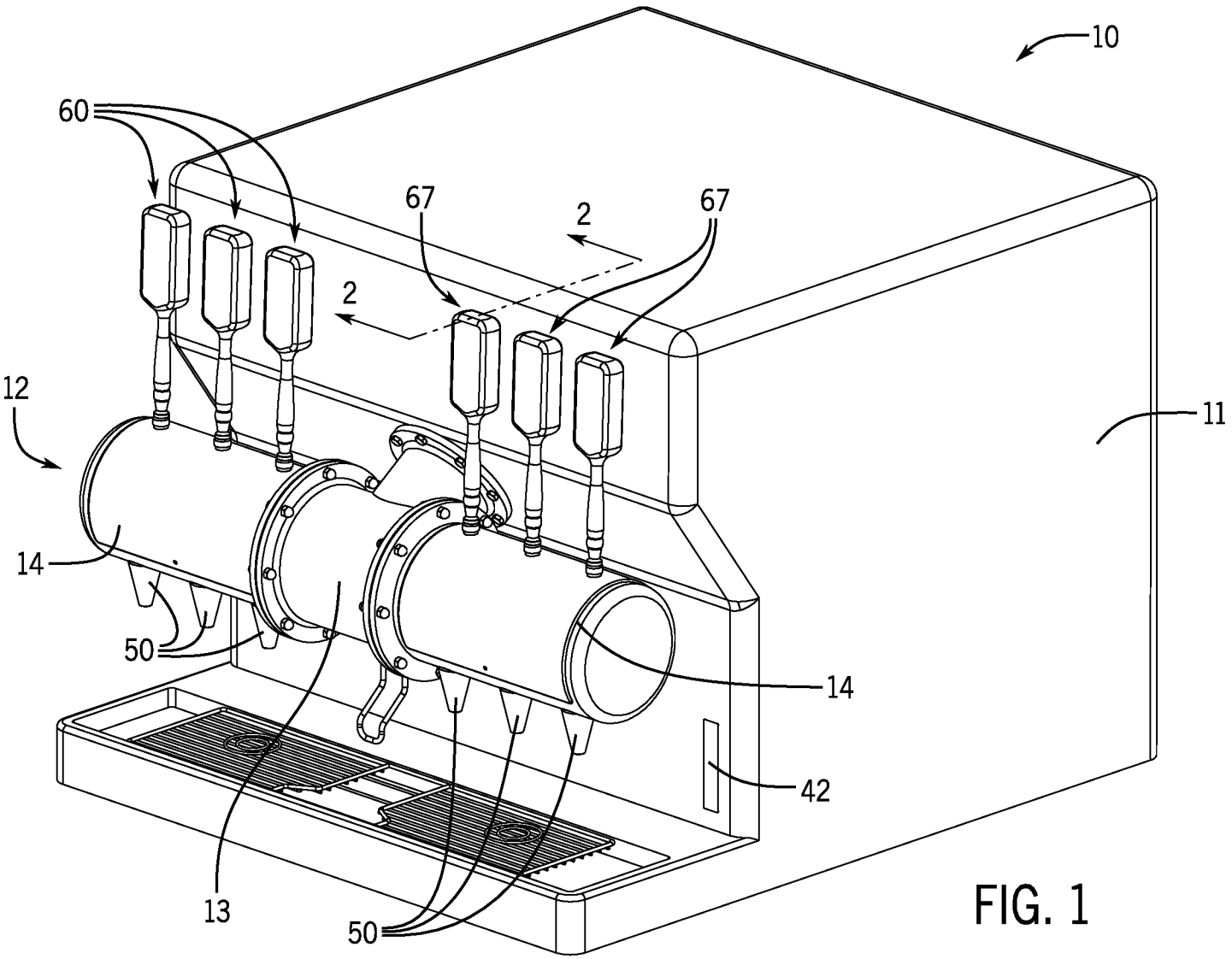
FIG. 1 is a perspective view of an example beverage dispensing machine of the present disclosure.

FIG. 1 depicts an example beverage dispensing machine 10 for dispensing mixed beverages, e.g. post-mixed beverages, to an operator. The example beverage dispensing machine 10 depicted has an enclosure 11 to thereby protect and conceal the interior components of the beverage dispensing machine 10 and a valve housing 12 which conceals and protects one or more valve assemblies 20 (FIG. 2) from which fluids (e.g. flavoring syrup, carbonated water) dispense to form a mixed beverage.

Figure 2:
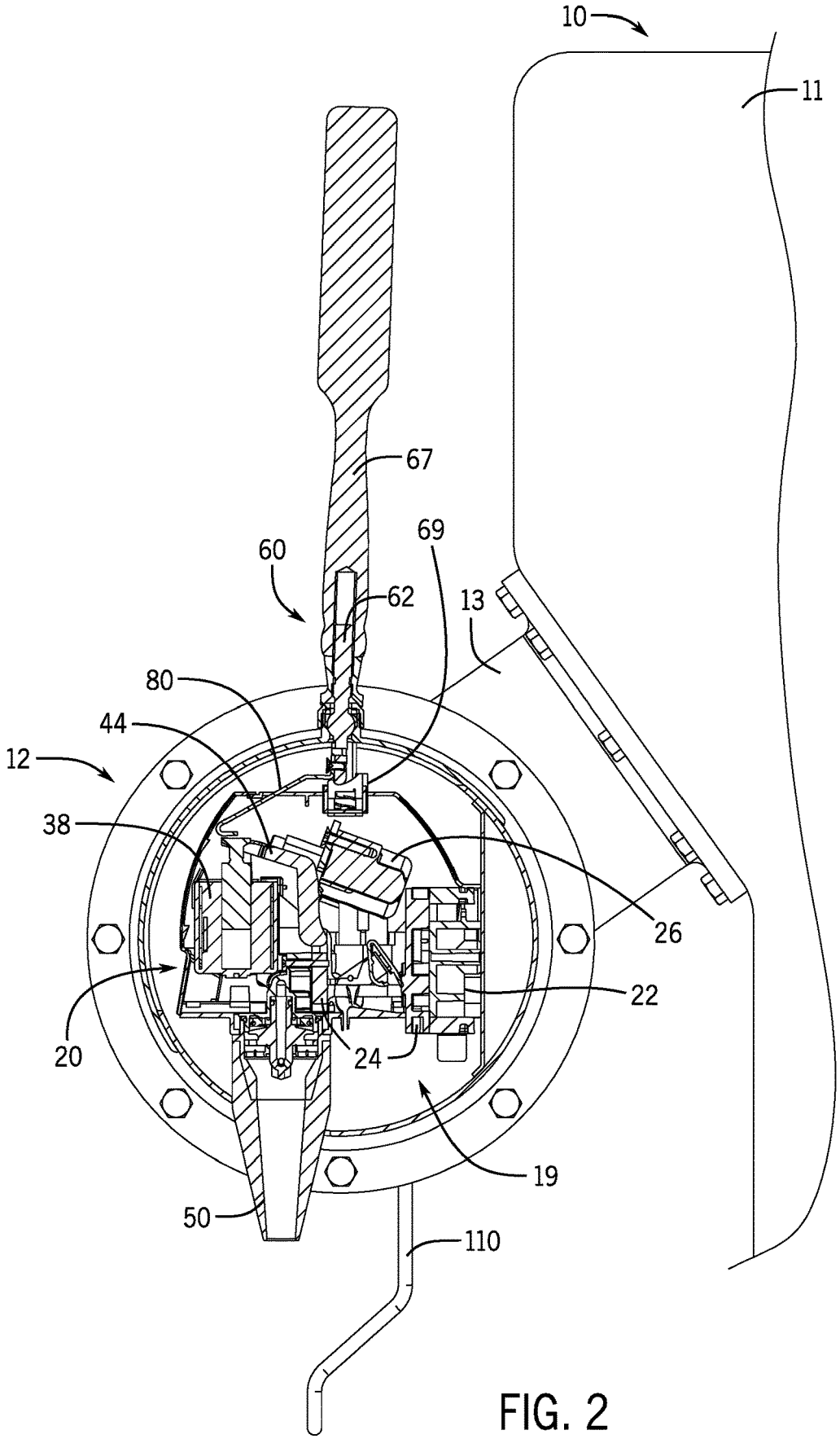
FIG. 2 is a cross-sectional view of the beverage dispensing machine along line 2-2 on FIG. 1.

FIG. 2 depicts one valve assembly 20 and one handle assembly 60 of the present disclosure relative to the valve housing 12 and the enclosure 11. In operation, the operator manually pivots a handle 67, which is connected to the valve housing 12, to operate one of the valve assemblies 20 such that the mixed beverage is dispensed through a nozzle 50 to the operator. The type, size, and/or shape of the valve housing 12 can vary, and in the example depicted, the valve housing 12 includes a T-shaped pipe fitting 13 coupled to the enclosure 11 and a pair of cylindrical pipes 14 (FIG. 1) that are removably coupled to the T-shaped pipe fitting 13. The cylindrical pipes 14 are each formed from two C-shaped members (see FIG. 8).

Figure 3:
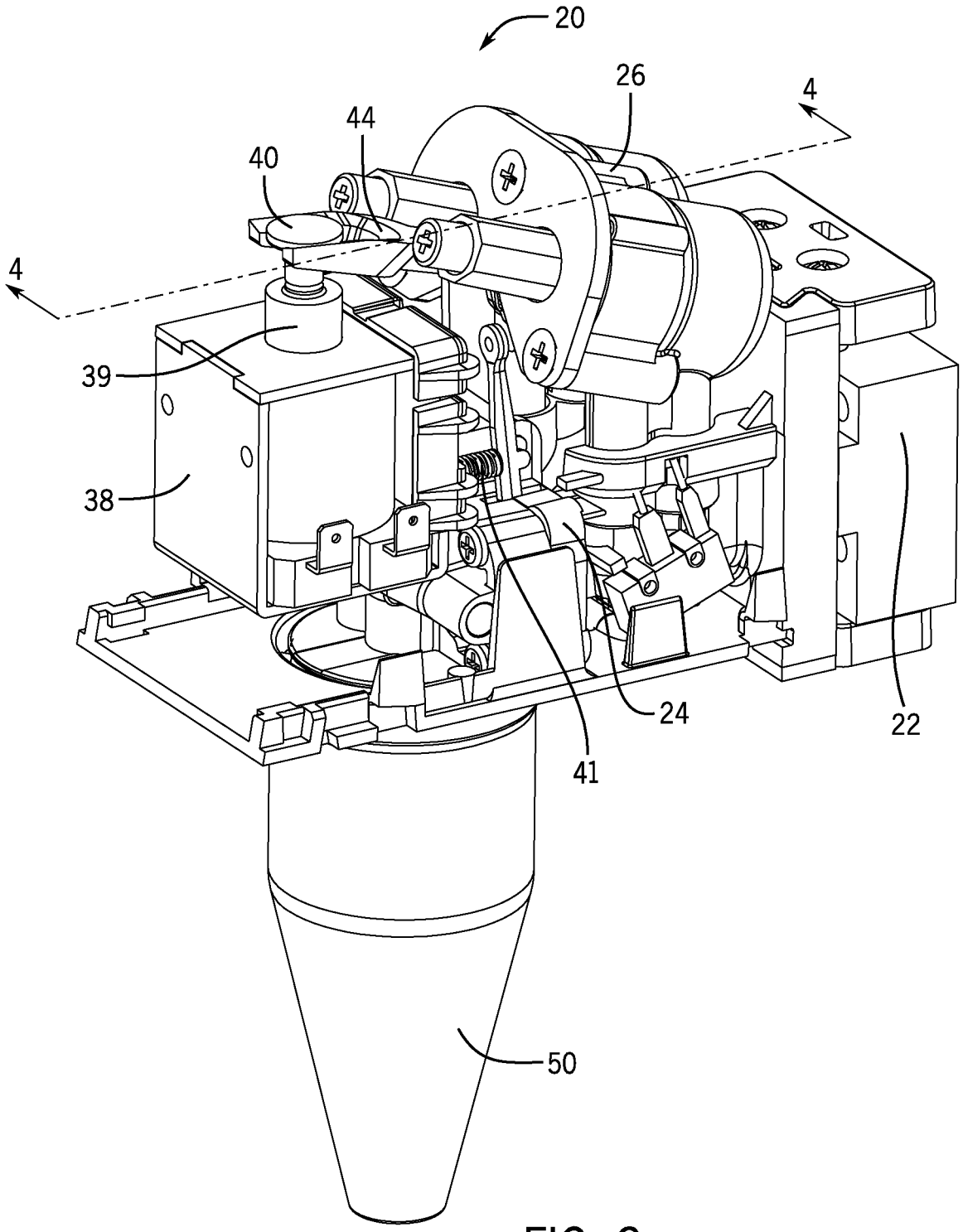
FIG. 3 is an enlarged perspective view of a valve assembly of the present disclosure.
Figure 4:
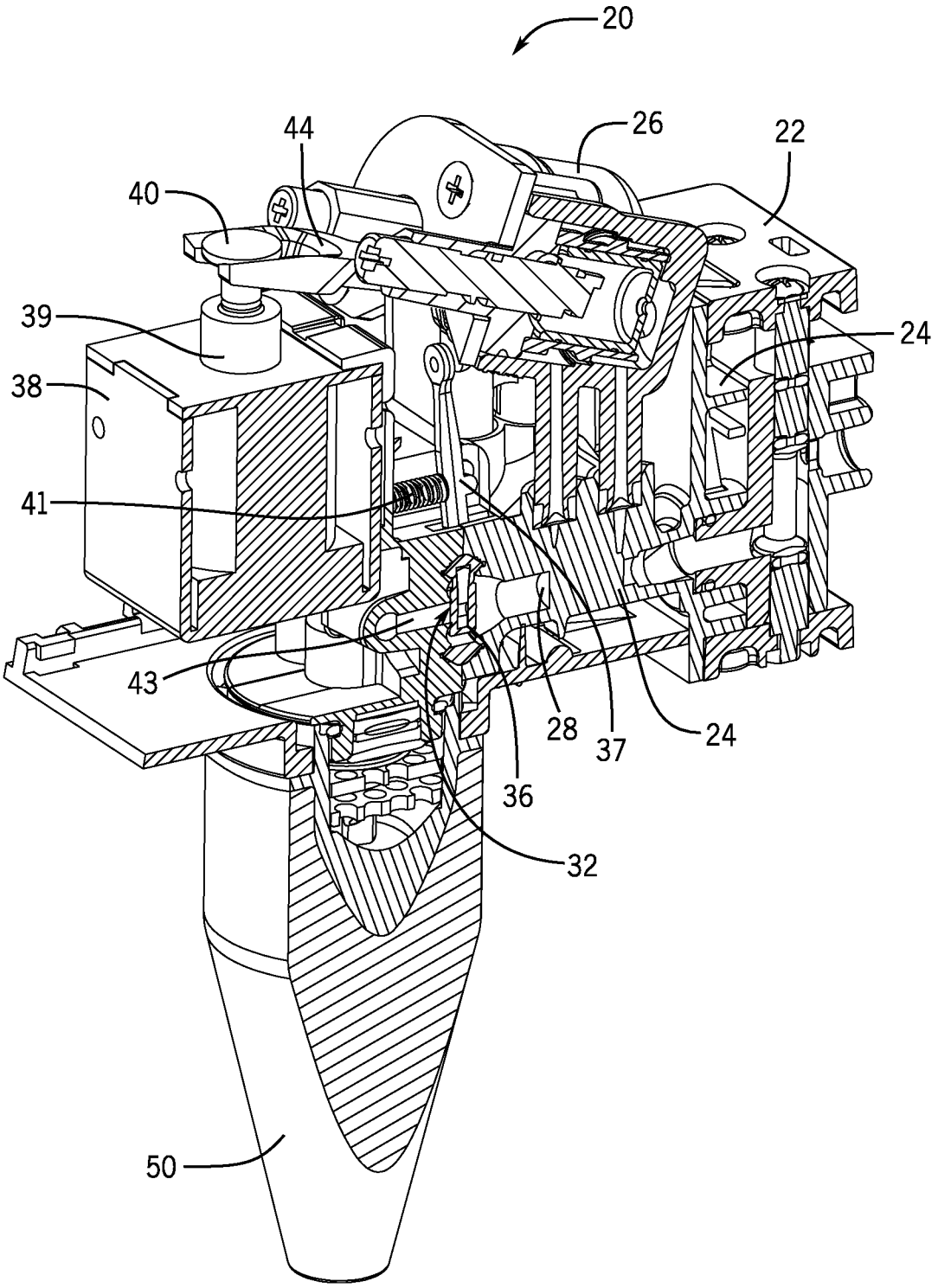
FIG. 4 is a cross-sectional view of the valve assembly of FIG. 3 along line 4-4.
Figure 5:
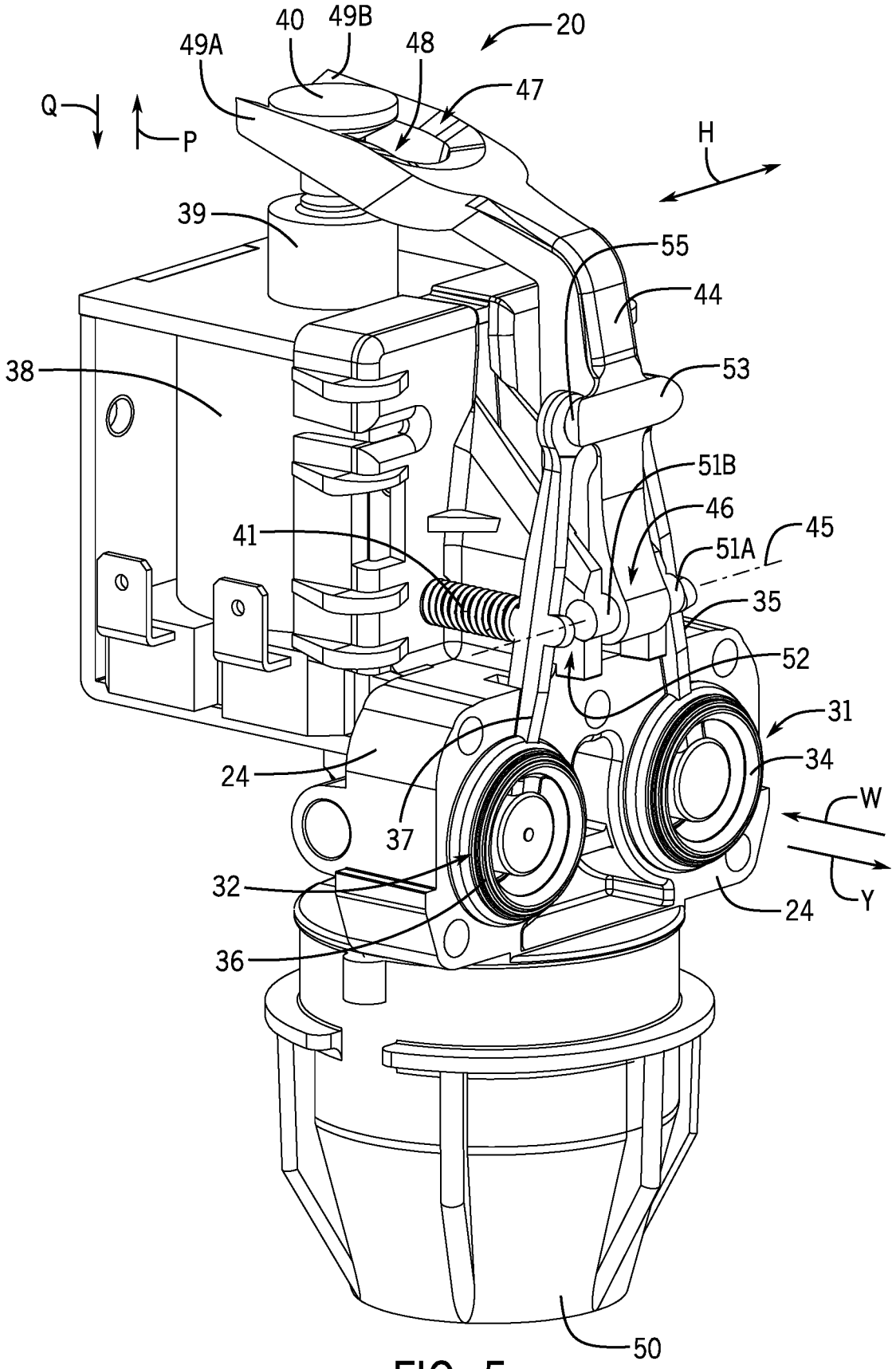
FIG. 5 is a partial perspective view of the valve assembly of FIG. 3.

Referring now to FIGS. 3-5, the valve assembly 20 is shown in greater detail. As is briefly mentioned above, each valve assembly 20 is configured to dispense fluids which mix to form the mixed beverage (e.g. craft soda beverage). The fluids, a first fluid (e.g. diluents, water, carbonated water) and a second fluid (e.g. syrup solutions, concentrated fluids, highly concentrated fluids, brand beverage flavoring) are dispensed at a predetermined flow ratio (e.g. 1:2, 4:1) to form the mixed beverage. The first and second fluids are supplied to the valve assembly 20 via fluid supply lines (not shown) from fluid storage containers (e.g. carbonated water tank, bag-in-box syrup storage unit, potable water line) (not shown). The fluid supply lines, e.g., a carbonated water supply line and a flavoring syrup supply line, are coupled to a backblock assembly 22. The valve assembly 20 has a valve body 24 removably connected to the backblock assembly 22 and in fluid communication with the backblock assembly 22.

The valve assembly 20 also has a flow control device 26 which is connected to the valve body 24 and configured to control the flow of the fluids through the valve assembly 20. That is, the flow control device 26 controls (e.g. limits) the flow of the fluids through the valve assembly 20 such that the fluids are dispensed from the valve assembly 20 via a nozzle 50 at the predetermined flow ratio. In one non-limiting example, the flow control device 26 controls the flow of the first and second fluids through the valve assembly such that four parts of the first fluid (e.g. carbonated water) are dispensed for every one part of the second fluid (e.g. flavor syrup) (the flow ratio of the fluids is 4:1). Reference is made to above-incorporated U.S. Pat. Nos. 5,607,083 and 5,845,815 for further description of the components and operation of conventional post-mix beverage dispensing machines and flow control devices.

Referring specifically to FIG. 4, the valve body 24 includes a first inlet (not shown) that receives the first fluid and a second inlet 28 that receives the second fluid from the flow control device 26. The first fluid is dispensed through a first orifice 31 (FIG. 5) and the second fluid is dispensed through a second orifice 32. The fluids are then conveyed through various bores and/or channels, such as channel 43, to the nozzle 50 where the fluids are mixed to form the mixed beverage and dispensed to the operator.

Referring to FIG. 5, a section of the valve assembly 20 and the valve body 24 is depicted. A first valve seal 34, such as a banjo seal, is positioned at the first orifice 31 and is selectively movable to open and close the first orifice 31. Similarly, a second valve seal 36 (see also FIG. 4) is positioned at the second orifice 32 and is selectively movable to open and close the second orifice 32.

Each valve seal 34, 36 is connected to a lever 35, 37 that can be actuated to thereby open the valve seals 34, 36. When the valve seals 34, 36 open, annular gaps (not shown) are defined between the valve seals 34, 36 and the orifices 31, 32. Accordingly, the fluids flow through the annular gaps, respectively, and are dispensed via the nozzle 50. Springs 41 apply a force to the levers 35, 37 in an upstream direction (see arrow U) to thereby bias the valve seals 34, 36 to a closed position.

The valve assembly 20 also includes a yoke arm 44 (see also FIG. 6-7) that is pivotably coupled to the valve body 24. As the yoke arm 44 pivots relative to the valve body 24, the yoke arm 44 moves and actuates the levers 35, 37 to open the valves seals 34, 36. The yoke arm 44 has a first end 46 coupled to the valve body 24 at a pivot axis 45. The yoke arm 44 has a second end 47, which is opposite the first end 46, is coupled to a solenoid valve 38. The solenoid valve 38 includes a shank 39 with an enlarged upper flange 40 (e.g. the upper flange 40 has a diameter greater than the diameter of the shank 39) (the operation of the solenoid valve 38 is described hereinbelow). The second end 47 of the arm 44 has a pair of forks 49A, 49B and an opening 48 therebetween. The opening 48 is configured to receive the shank 39, and the opening 48 has a width that is less than the diameter of the upper flange 40 such that the upper flange 40 contacts and acts on the forks 49A, 49B when the shank 39 is moved in a second direction (see arrow Q) opposite a first direction (see arrow P).

The yoke arm 44 of the present disclosure also includes several features that account for or overcome problems that occur when yoke arms of conventional valve assemblies pivot out of plane or "rock" in a direction parallel with the pivot axis (see arrow H). In conventional valve assemblies, large amounts of "rocking" can cause the mixed beverage to be incorrectly dispensed due to the inadvertent opening of the valve seals or incorrect timing of the opening of the valve seals. These incorrectly mixed beverages may have incorrect flow ratios. The present inventors have also recognized that "rocking" of the yoke arm becomes more pronounced when the pressures of the fluids are not equal. In these examples, a larger force must be applied by the yoke arm to the valve seal which blocks the fluid with the higher pressure (relative to the pressure of the other fluid) (e.g. carbonated water). The larger force applied by the yoke arm is directed in the upstream direction (see FIG. 5 arrow U) against the pressure of the fluid. However, the valve seal associated with the fluid having lower pressure does not require the same force to open. Accordingly, if the yoke arm applies equal forces to both the valve seals the yoke arm may "rock" in a direction toward the valve seal which blocks the lower pressure fluid. As such, the valve seal which blocks the lower pressure fluid may open inadvertently or before the other valve seal opens. This may cause the fluids to be dispensed at an incorrect flow ratio. The "rocking" of the yoke arm may also cause the valve seals to open wider than necessary. Thus, it is advantageous to reduce the amount and/or account for the "rocking" of the yoke arm 44 to ensure that the fluids are dispensed at the correct flow ratio. The yoke arm 44 of the present disclosure, further described below, has been designed to account for or minimize "rocking" of the yoke arm 44.

Figure 6:
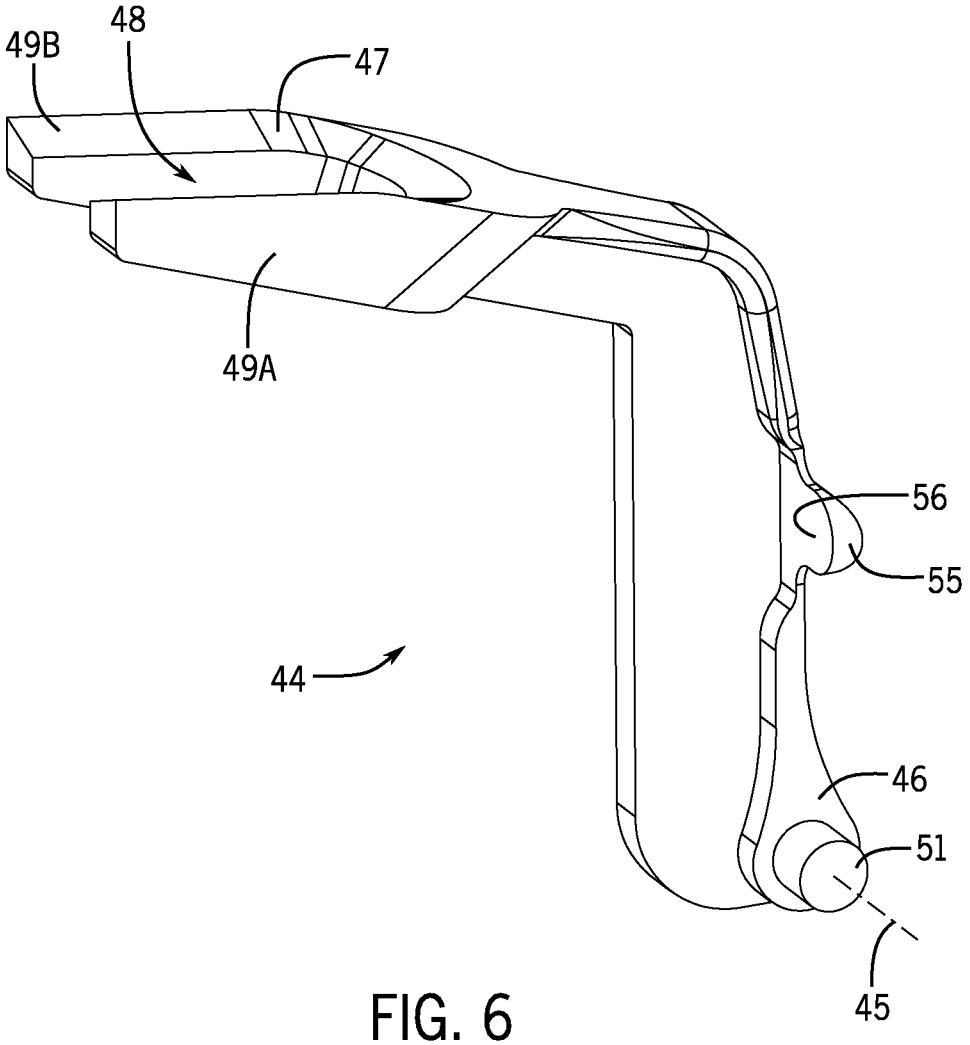
FIG. 6 is a perspective view of an example yoke arm.
Figure 7:
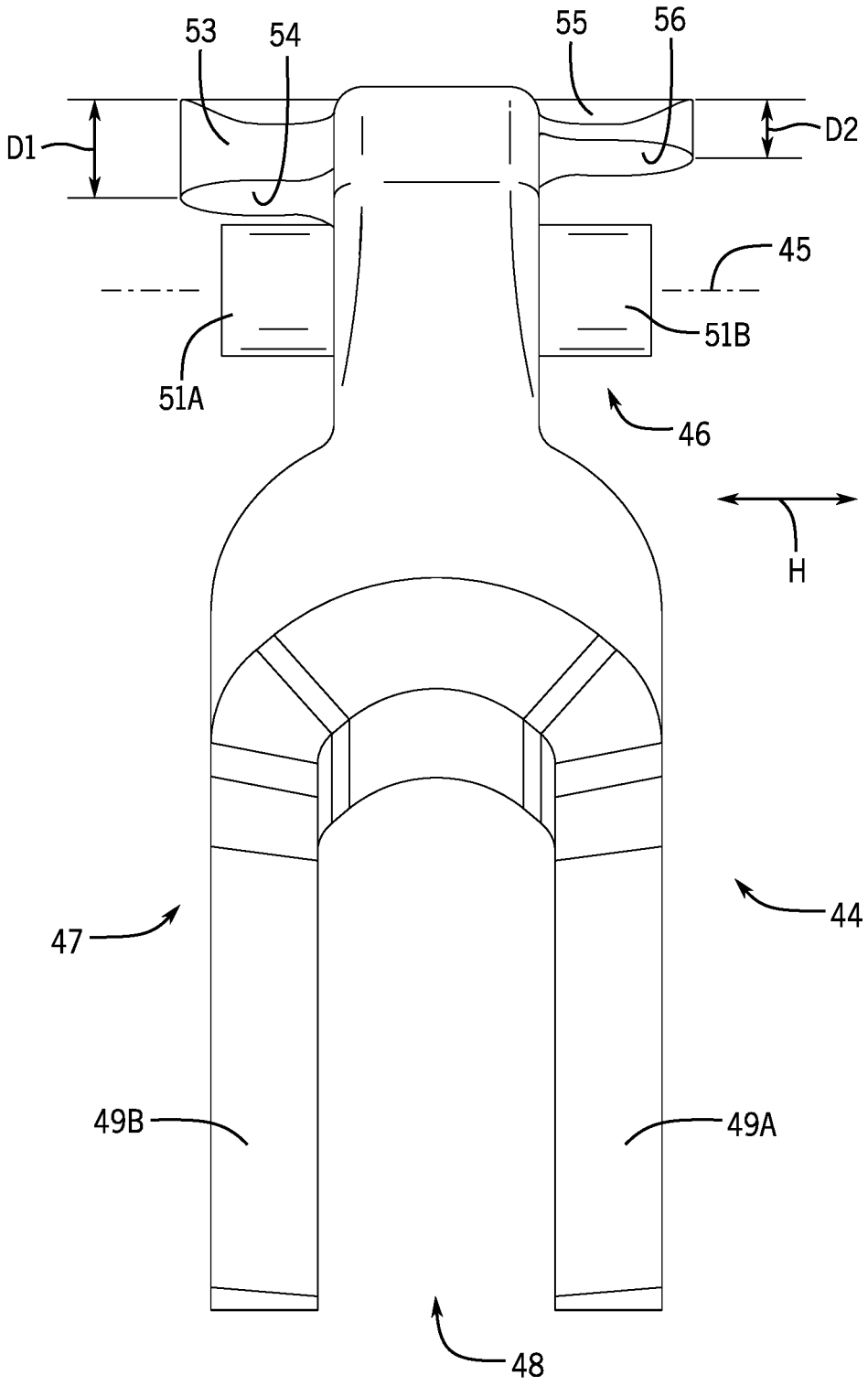
FIG. 7 is a top view of the yoke arm of FIG. 6.

The yoke arm 44 of the present disclosure is shown in greater detail in FIGS. 6-7. The first end 46 of the yoke arm 44 has a pair of bosses 51A, 51B that are received in an opening 52 (FIG. 5) of the valve body 24. The bosses 51A, 51B are sized to correspond with and/or closely match the opening 52. That is, the size and/or shape of the bosses 51A, 51B and the opening 52 closely match such that the bosses 51A, 51B and the opening 52 fit tightly or snuggly together to minimize the amount of movement or "play" between the bosses 51A, 51B and the opening 52. Accordingly, the orientation of the pivot axis 45 relative to the valve body 24 is fixed (e.g. the pivot axis 45 does not move or "wobble" as the yoke arm 44 pivots).

The yoke arm 44 also includes a pair of engagement tabs, namely a first tab 53 and a second tab 55, that are configured to contact (and actuate) the levers 35, 37, respectively, as the yoke arm 44 pivots. The first tab 53 has a first width or thickness D1 (FIG. 7) and a first engagement surface 54 that contacts the first lever 35 (FIG. 5). The second engagement tab 55 has a second width or thickness D2 (FIG. 7) that is less than the first width D1 and a second engagement surface 56 that is configured to contact the second lever 37 (FIG. 5). The difference between the first width and the second width can vary and is dependent on the pressures of fluids received by the valve assembly 20 and/or the size of the orifices 31, 32 (FIG. 5). In one non-limiting example, the difference between the first width D1 and the second width D2 is 0.050 inches.

As the yoke arm 44 pivots, the tabs 53, 55 contact the levers 35, 37 (FIG. 5) at different times due to the different widths D1, D2 of the engagement tabs 53, 55 which causes the yoke arm 44 to first act on or apply a force to the lever which is contacted by the tab with the larger width (e.g. the first tab 53 contacts the first lever 35 before the second tab 55 contacts the second lever 37). In a specific example, the first tab 53 contacts the first lever 35 (FIG. 5) which is connected to the first valve seal 34 (FIG. 5) that blocks the higher pressure fluid (e.g. carbonated water). However, due to the force of the higher pressure fluid acting in a downstream direction (see FIG. 5 arrow W) the first valve seal 34 does not open when the first tab 53 initially acts on the first lever 35. As the yoke arm 44 continues to pivot, the second tab 55 contacts the first lever 35 which is connected to the second valve seal 36 and blocks the lower pressure fluid (e.g. syrup). As such, the yoke arm 44 is now acting on both levers 35, 37. Further pivoting of the yoke arm 44 causes the valve seals 34, 36 to open. The manner or sequence in which the valve seals 34, 36 open can be further dictated by the design of the yoke arm 44 and the tabs 53, 55. For example, the tabs 53, 55 may be designed such that further pivoting of the yoke arm 44 causes the first valve seal 34 to open slightly earlier than the second valve seal 36. In another example, further pivoting of the yoke arm 44 causes the valve seals 34, 36 to simultaneously open. As such, the correct flow ratio of the fluids is dispensed from the valve assembly 20 and "rocking" of the yoke arm is minimized or prevented. Furthermore, the difference in dimensions of the tabs 53, 55 may advantageously cause one of the valve seals 34, 36 to remain open slightly longer than the other valve seal 34, 36 to thereby flush at least one of the channels 43 (see FIG. 4) downstream from the valve seals 34, 36 with one the fluids (e.g. carbonated water). In certain examples, the valve seals 34, 36 are gradually or progressively opened as the yoke arm 44 pivots.

Figure 10:
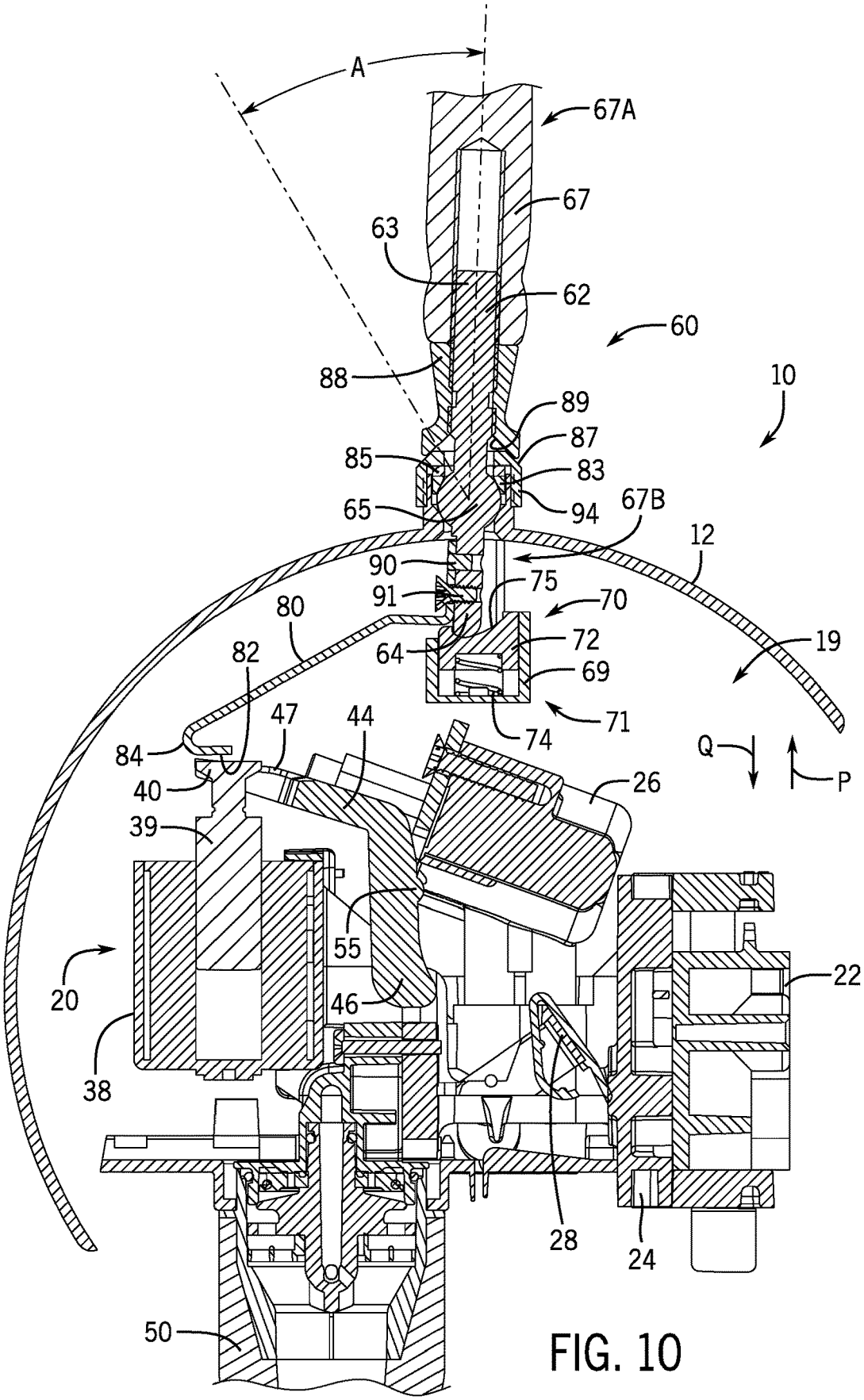
FIG. 10 is a cross-sectional view of the valve assembly and the handle assembly shown in FIG. 2 with the handle in a rest position.
Figure 11:
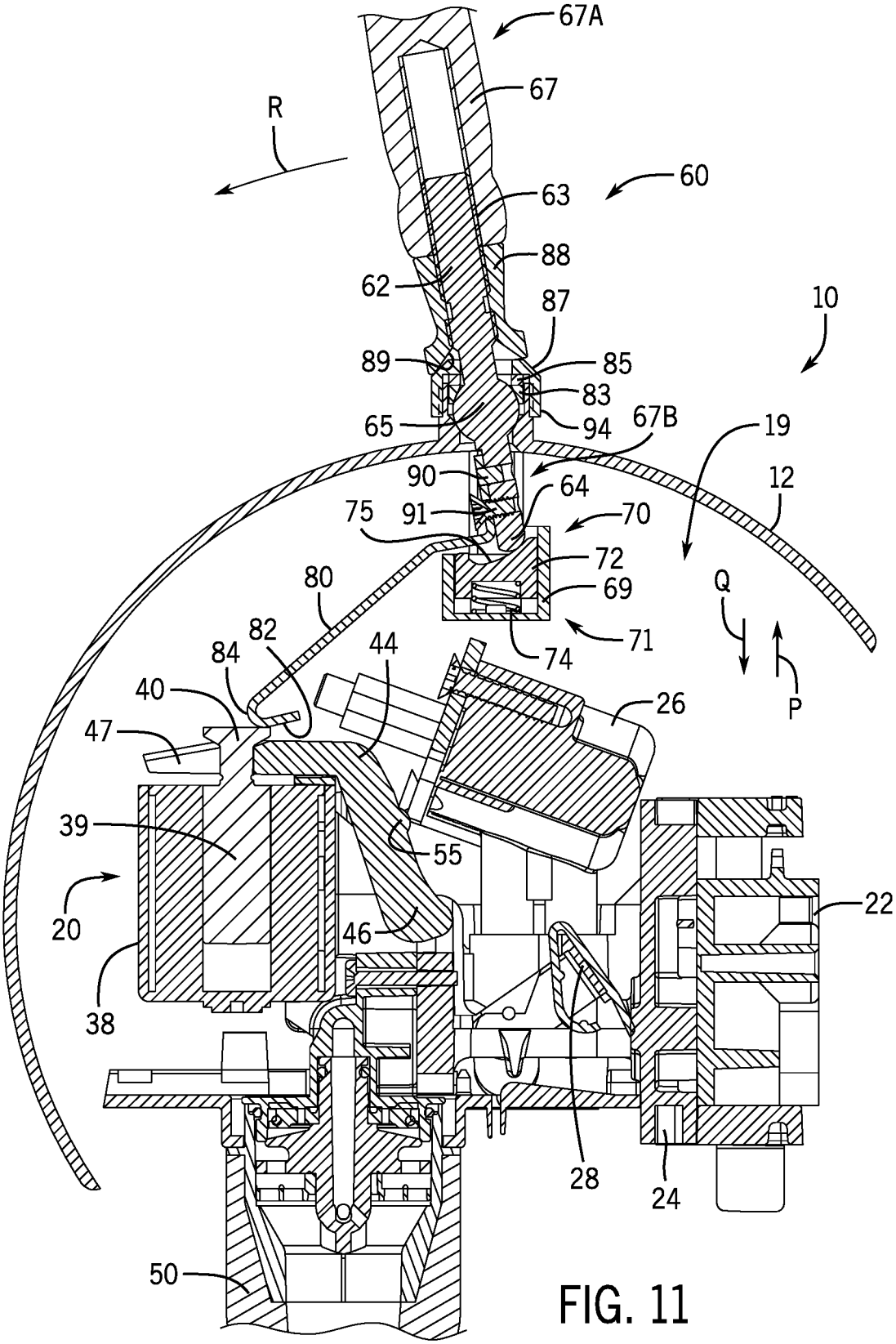
FIG. 11 view like FIG. 10 with the handle in an active position.

Referring back to FIG. 5, the yoke arm 44 is pivoted by the shank 39 of the solenoid valve 38 as the shank 39 is moved in the second direction (see arrow Q). The shank 39 can be electrically moved in the second direction by energizing the solenoid valve 38. The solenoid valve 38 is electrically coupled to a power source (not shown), and the solenoid valve 38 is energized when a switch 42 (FIG. 1) is closed. That is, when the solenoid valve 38 is energized, the shank 39 is moved in the second direction (arrow Q) from an extended position (FIG. 10) to a retracted position (FIG. 11) and the upper flange 40 acts on (e.g. pulls) the second end 47 of the yoke arm 44 to thereby pivot the yoke arm 44 from a first position (FIG. 10) to a second position (FIG. 11).

As described above, pivoting of the yoke arm 44 causes the valve seals 34, 36 to open and the fluids to be dispensed from the valve assembly 20 to the nozzle 50. When the switch 42 (FIG. 1) is open, the shank 39 returns to the extended position (FIG. 11) (the shank 39 moves in a first direction, see arrow P) and the yoke arm 44 returns to the first position (FIG. 10). As such, the valve seals 34, 36 close due to the force applied by the springs 41 (FIG. 5) to the levers 35, 37. Note that this example operational sequence does not permit the operator to dispense the first and second fluids at flow rates less than the maximum flow rate. In certain examples, the switch 42 is an ADA push-button user panel. When the operator engages the user panel (e.g. the operator presses a mechanical push-button or touchscreen panel), the switch 42 closes and the mixed beverage dispenses via the nozzle 50. In another example, the switch 42 can be connected to a mechanical lever 110 that is positioned relative to the nozzle 50 such that pressing a cup against the mechanical lever 110 (FIG. 2) causes the switch 42 to close, the solenoid valve 38 to energize, and the mixed beverage is dispensed via the nozzle 50, as described above.

The shank 39 can also be moved in the second direction by non-electrical devices, and through research and experimentation, the present inventor has developed a handle assembly 60 that moves the shank 39 and thereby pivots the yoke arm 44 without energizing the solenoid valve 38. The handle assembly 60 allows the operator to dispense the mixed beverage at different flow rates (e.g. a low flow rate, a medium flow rate, the maximum flow rate), based on the amount of movement or force applied to the handle 67.

Figure 8:
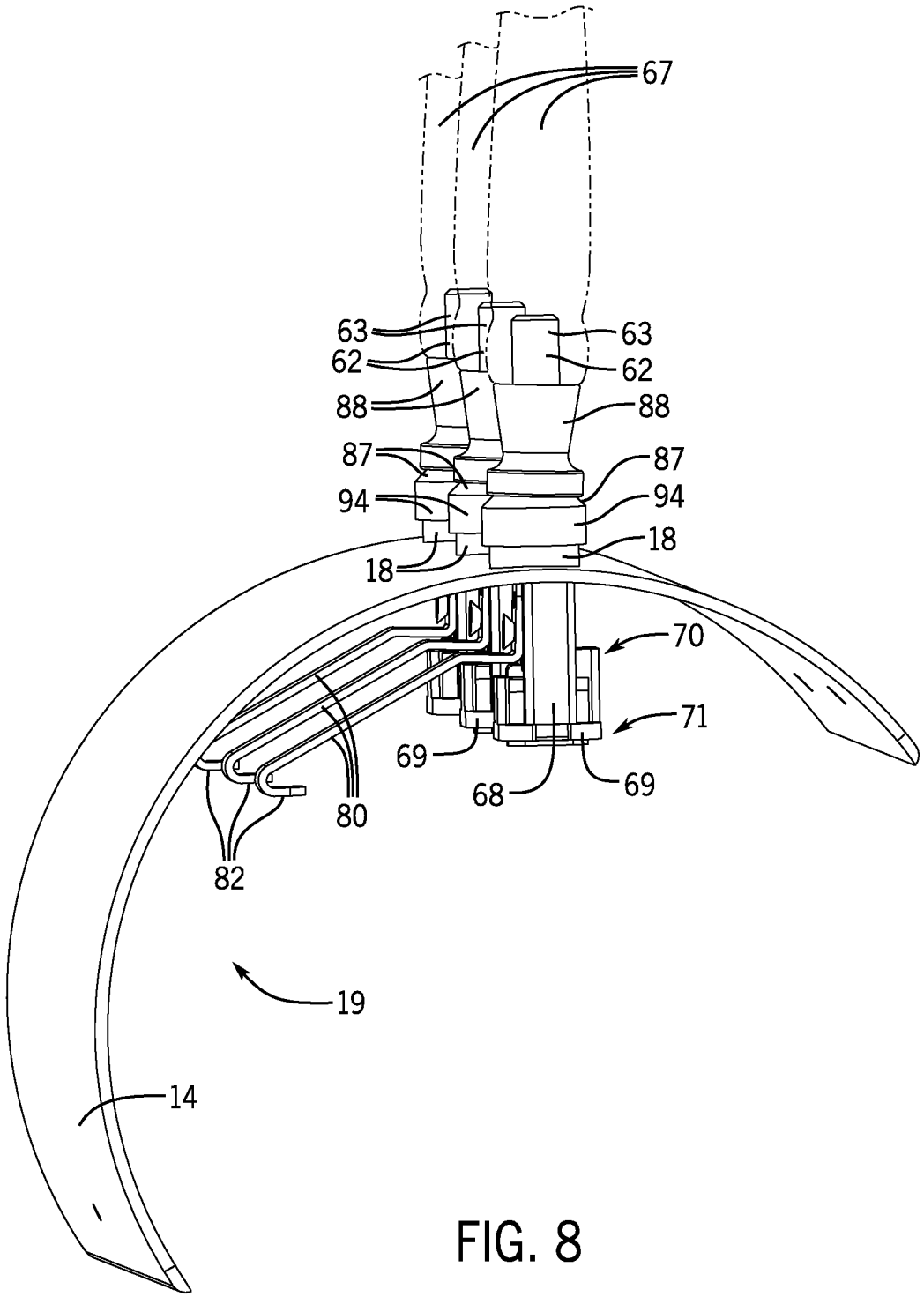
FIG. 8 is a perspective view of three example handle assemblies coupled to a valve housing.
Figure 9:
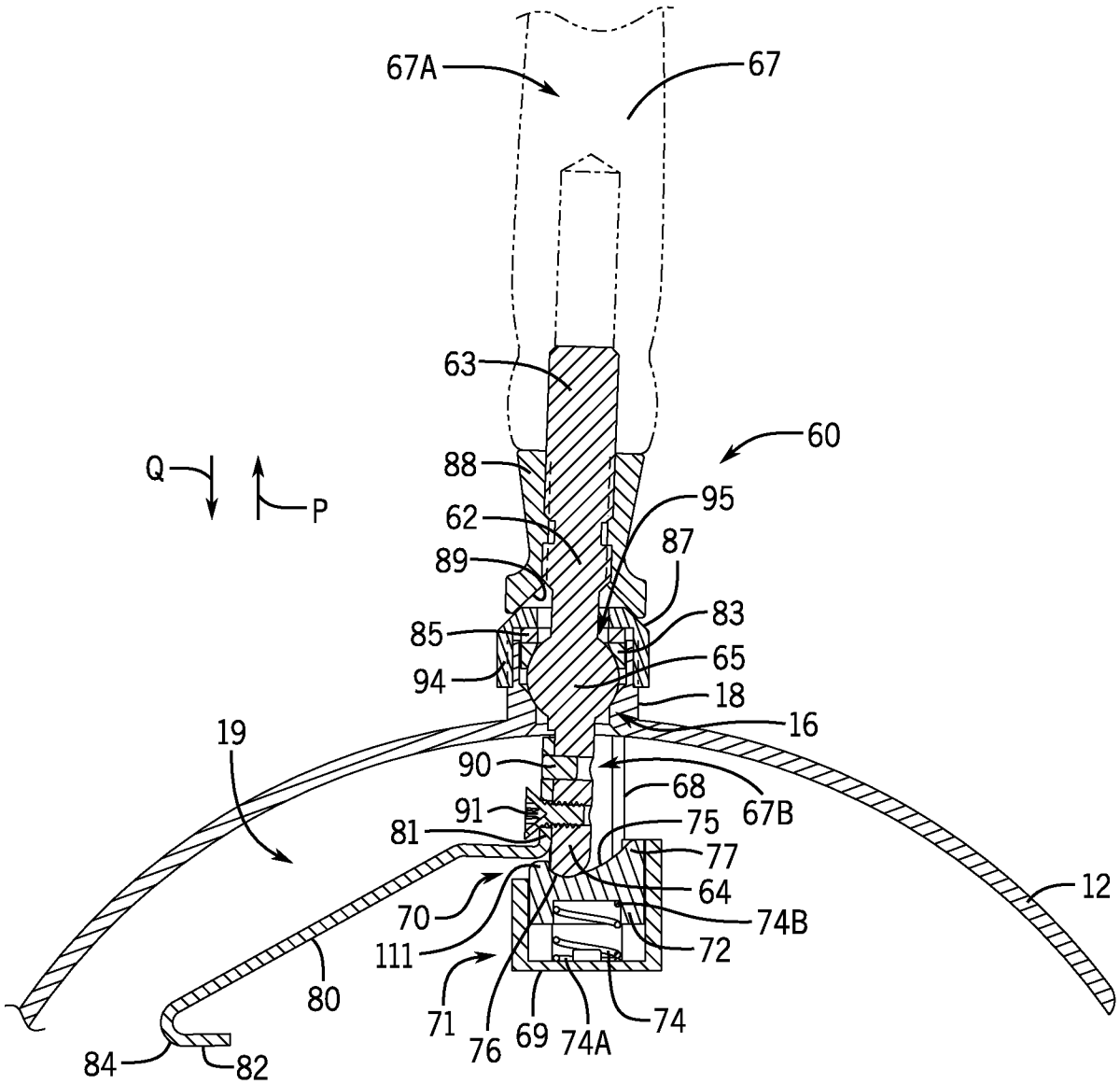
FIG. 9 is a cross-sectional view of one of the handle assemblies depicted in FIG. 8.

The handle assembly 60 of the present disclosure is depicted in FIGS. 8-9. FIG. 8 depicts three handle assemblies 60, and FIG. 9 depicts a cross-sectional view through one handle assembly 60. Referring specifically to FIG. 9, the handle assembly 60 includes a handle 67 with a first end 67A and an opposite second end 67B. The second end 67B has a handle bracket 62 disposed in and extending through an opening 16 in the valve housing 12. The handle bracket 62 has a threaded first end 63 extending in a first direction (see arrow P) away from the valve assembly 20 (FIG. 10) and an opposite, second end 64 extending in a second direction (see arrow Q) toward the valve assembly 20 (FIG. 10). The handle bracket 62 has a pivot portion 65 about which the handle bracket 62 and the handle 67 pivot (described herein) positioned between the ends 63, 64. In the example depicted, the pivot portion 65 is enlarged and spherically shaped relative to the remainder of the handle bracket 62. The pivot portion 65 of the handle bracket 62 is pivotally received into a receiver member 18 of the valve housing 12. A washer 83 and a gasket 85 are positioned around the handle bracket 62 at the receiver member 18 create a fluid tight seal between the receiver member 18 and the handle bracket 62. A cap member 94 has a sloped outer surface 87 and a bore 95 through which the first end 63 of the handle bracket 62 extends. The cap member 94 is coupled to the receiver member 18 to thereby lock the washer 83, gasket 85, and the handle bracket 62 to the receiver member 18 and the valve housing 12.

The handle assembly 60 also includes a sleeve member 88 that is removably coupled (e.g. with screw threads) to the first end 63 of the handle bracket 62. The sleeve member 88 includes an inner sloped surface 89 that corresponds to the outer surface 87 of the cap member 94. The inner sloped surface 89 of the sleeve member 88 slides along the outer surface 87 of the cap member 94 as the handle 67 and handle bracket 62 pivots. The first end 67A of the handle 67 can be disconnected from the handle bracket 62. The handle 67 can be any suitable material and may include indicia to indicate the type of mixed beverage that is dispensed when the handle 67 is pivoted.

Turning now to the portion of the handle assembly 60 that extends in the second direction (arrow Q) toward the valve assembly 20 (FIG. 5) and is located within the cavity 19 (FIG. 2) defined by the valve housing 12, The handle assembly 60 includes at least one support member 68 for supporting a plate receiver 69 from the valve housing 12. The plate receiver 69 has an open end 70 and an opposite, closed end 71. A bearing plate 72 is received into the plate receiver 69, and a biasing member 74 (e.g. spring) is positioned between the closed end 71 of the plate receiver 69 and the bearing plate 72 to thereby bias the bearing plate 72 toward the open end 70 of the plate receiver 69. Specifically, the biasing member 74, has a first end 74A contacting the closed end 71 and a second end 74B contacting the bearing plate 72.

The bearing plate 72 has an upper or bearing surface 75 along which the second end 67B of the handle 67 (e.g. the second end 64 of the handle bracket 62) moves as the handle 67 is pivoted. The bearing surface 75 is curved and has a first end 76 and an opposite second end 77. When the handle 67 is in a rest position (FIG. 10), the second end 67B of the handle 67 is at the first end 76 of the bearing surface 75. A lip 111 at the first end 76 of the bearing surface 75 prevents the second end 67B of the handle 67 from moving off the bearing surface 75 (e.g. the lip 111 restrains the second end 67B of the handle 67 on the bearing surface 75). As the handle 67 pivots to an active position (FIG. 11), the second end 67B of the handle 67 moves along the bearing surface 75 toward the second end 77. As the second end 67B of the handle 67 moves toward the second end 77, the second end 67B of the handle 67 cams or moves the bearing plate 72 toward the closed end 71 of the plate receiver 69 and thereby compresses the biasing member 74 (FIG. 10). Accordingly, when operator releases the handle 67, the biasing member 74 forces (e.g. spring force) the bearing plate 72 toward the open end 70 of the plate receiver 69 such that the second end 67B of the handle 67 is cammed along the bearing surface 75 to the first end 76 of the bearing surface 75 and the handle 67 is biased or returns to the rest position (FIG. 10). The second end 67B of the handle 67 is curved to closely match or correspond with the first end 76 of the bearing surface 75. The second end 67B of the handle 67 is seated at the first end 76 of the bearing surface 75 when the handle 67 is not being moved pivoted.

The handle assembly 60 includes a leg 80 coupled to the second end 67B of the handle 67 (e.g. connected to the second end 64 of the handle bracket 62). The leg 60 has a first leg end 81, coupled to the second end 67B of the handle 67 with a set screw 90 and a fastener 91 (e.g. screw, adhesive), and an opposite second leg end 82 that has a curved contact surface 84 that contacts and acts on the shank 39 (FIGS. 10-11, described herein).

Referring now to FIGS. 10-11, an example operational sequence of the handle assembly 60 and the valve assembly 20 is depicted. In FIG. 10, the handle 67 is in the rest position such that the leg 80 is spaced apart from the shank 39 and the yoke arm 44 is in a first position. Accordingly, the valve seals 34, 36 are closed and mixed beverage does not dispense via the nozzle 50.

Now referring to FIG. 11, the operator dispenses the mixed beverage by pivoting the handle 67 from the rest position (FIG. 10) to an active position (FIG. 11). The operator pivots the handle 67 by applying a pulling force (see force arrow R) to the handle 67. As the pulling force is applied and the handle 67 pivots, the second end 67B of the handle 67 moves along the bearing surface 75 of the bearing plate 72 and cams the bearing plate 72 toward the closed end 71 of the plate receiver 69 in the second direction (see arrow Q). At the same time the leg 80 moves in the second direction to contact and act on the shank 39. As such, the shank 39 moves in the second direction and pivots the yoke arm 44 toward the second position (as described above). As the yoke arm 44 pivots, the valve seals 34, 36 (FIG. 5) open and the mixed beverage is dispensed.

The flow rate of the mixed beverage dispensed from the nozzle 50 is related to the magnitude of the pulling force (see force arrow R) applied to the handle 67. For example, when a small pulling force is applied to the handle 67 (e.g. the handle 67 is pivoted 6 degrees relative to the rest position; see angle A on FIG. 11), the mixed beverage is dispensed at a small or low flow rate. When a large pulling force greater than the small pulling force is applied to the handle 67 (e.g. the handle is pivoted 12 degrees relative to the rest position) the mixed beverage is dispensed at a large or high flow rate and/or the maximum flow rate. Accordingly, the operator can vary the flow rate of the mixed beverage by applying different pulling forces to the handle 67.

Once the operator releases the handle 67, the biasing member 74 and the spring 41 (FIG. 5) cause the handle 67 to return to the rest position (FIG. 10). Accordingly, the leg 80 is spaced apart from the shank 39, the shank 39 moves in the first direction (see arrow P), the yoke arm 44 pivots back to the first position, and the valve seals 34, 36 (FIG. 5) close.

In certain examples, the beverage dispensing machine includes a valve body configured to receive a first fluid and a second fluid and dispense the first fluid through a first orifice and the second fluid through a second orifice, a first valve seal movable to open and close the first orifice, and a second valve seal movable to open and close the second orifice. An arm is pivotally coupled to the valve body and pivoting of the arm relative to the valve body moves the first valve seal and the second valve seal and thereby opens the first orifice and the second orifice. A solenoid valve is configured to pivot the arm. A handle has a leg, and the handle is pivotable into and between a rest position in which the valve seals are closed and an active position in which the valve seals are open. As the handle moves from the rest position to the active position, the leg acts on the solenoid valve such that the arm pivots and the valve seals open. As the handle pivots from the rest position to the active position the valve seals gradually open. The handle has a first end and an opposite second end.

In certain examples, a bearing plate is included along which the second end of the handle moves as the handle pivots. The bearing plate opposes pivoting of the handle toward the active position. A plate receiver with an open end and an opposite closed end can also be included such that as the handle pivots the bearing plate moves toward the closed end of the plate receiver. A biasing member can be included between the bearing plate and the closed end of the plate receiver so as to oppose movement of the bearing plate toward the closed end and thereby bias the handle toward the rest position. The biasing member is a spring that is compressed as the bearing plate moves toward the closed end. The spring applies a spring force to the bearing plate in a direction away from the closed end to thereby oppose movement of the bearing plate toward the closed end and bias the handle toward the rest position. The bearing plate has a bore opposite the bearing surface, and wherein the spring has a first end that contacts the closed end of the plate receiver and a second end disposed in the bore of the bearing plate. The bearing plate has a bearing surface that is curved between a first end and an opposite second end, and the spring force causes the bearing plate to cam the second end of the handle toward the first end of the bearing surface. The second end of the handle is curved to match the first end of the bearing surface, and the second end of the handle is seated at the first end of the bearing surface when the handle is in the rest position. The bearing surface has a lip at the first end of the bearing surface to retain the second end of the handle on the bearing surface.

In certain examples, the beverage dispensing machine includes a valve housing that defines a cavity, a valve body disposed in the cavity and configured to receive a first fluid and a second fluid and dispense the first fluid through a first orifice and the second fluid through a second orifice, a first valve seal movable to open and close the first orifice, and a second valve seal movable to open and close the second orifice. An arm is pivotally coupled to the valve body, and pivoting of the arm relative to the valve body moves the first valve seal and the second valve seal and thereby opens the first orifice and the second orifice. A solenoid valve is included to pivot the arm. A handle is pivotally coupled to the valve housing and includes a leg extending from the handle. The handle is pivotable relative to the valve housing into and between a rest position in which the valve seals are closed and an active position in which the valve seals are open. As the handle moves from the rest position to the active position the leg acts on the solenoid valve such that the arm pivots and the valve seals gradually open. The handle has a first end and an opposite second end that extends into the cavity. In certain examples, a bearing plate is included in the cavity along which the second end of the handle moves as the handle pivots, and the bearing plate opposes pivoting of the handle toward the active position. In certain examples, a plate receiver is coupled to the valve housing and extends into the cavity. The plate receiver has an open end and an opposite closed end, and as the handle pivots the bearing plate moves toward the closed end of the plate receiver. A biasing member can be included between the bearing plate and the closed end of the plate receiver so as to oppose movement of the bearing plate toward the closed end and thereby bias the handle toward the rest position. The biasing member is a spring that compresses as the bearing plate moves toward the closed end, and the spring applies a spring force to the bearing plate in a direction away from the closed end to thereby oppose movement of the bearing plate toward the closed end and bias the handle toward the rest position.

In certain examples, a beverage dispensing valve includes a valve body configured to receive a first fluid and a second fluid and dispense the first fluid through a first orifice and the second fluid through a second orifice, a first valve seal movable to open and close the first orifice, a second valve seal movable to open and close the second orifice, and an arm pivotally coupled to the valve body. Pivoting of the arm relative to the valve body moves the first valve seal and the second valve seal and thereby opens the first orifice and the second orifice, and the arm acts on the first valve seal before the arm acts on the second valve seal. In certain examples, the first orifice and the second orifice simultaneously open. In certain examples, a first lever is coupled to the first valve seal, and a second lever is coupled to the second valve seal. As the arm pivots the arm actuates the first lever before the arm actuates the second lever. In certain examples, the arm has a first tab with a first thickness and a second tab with a second thickness less than the first thickness of the first tab such that the first tab contacts the first lever before the second tab contacts the second lever. In certain examples, the arm includes a first boss and an opposite second boss that extend in opposite directions along a pivot axis about which the arm pivots and the valve body has an opening corresponding to the first boss and the second boss in which the first boss and the second boss are received to thereby fix orientation of the pivot axis relative to the valve body.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A beverage dispensing machine comprising:

a valve body configured to receive a first fluid and a second fluid and dispense the first fluid through a first orifice and the second fluid through a second orifice;

a first valve seal movable to open and close the first orifice;

a second valve seal movable to open and close the second orifice;

an arm pivotally coupled to the valve body such that pivoting of the arm relative to the valve body moves the first valve seal and the second valve seal and thereby opens the first orifice and the second orifice; and a solenoid valve and a handle that are independently and separately operable to pivot the arm and thereby dispense the first fluid and the second fluid;

wherein the handle pivots independent of the arm.

2. A beverage dispensing machine comprising:

a valve body configured to receive a first fluid and a second fluid and dispense the first fluid through a first orifice and the second fluid through a second orifice;

a first valve seal movable to open and close the first orifice;

a second valve seal movable to open and close the second orifice;

an arm pivotally coupled to the valve body such that pivoting of the arm relative to the valve body moves the first valve seal and the second valve seal and thereby opens the first orifice and the second orifice; and a solenoid valve and a handle that are independently and separately operable to pivot the arm and thereby dispense the first fluid and the second fluid;

wherein when the handle is operated the handle contacts and moves a shank of the solenoid valve such that the shank pivots the arm.

3. A beverage dispensing machine comprising:

a valve body configured to receive a first fluid and a second fluid and dispense the first fluid through a first orifice and the second fluid through a second orifice;

a first valve seal movable to open and close the first orifice;

a second valve seal movable to open and close the second orifice;

an arm pivotally coupled to the valve body such that pivoting of the arm relative to the valve body moves the first valve seal and the second valve seal and thereby opens the first orifice and the second orifice; and a solenoid valve and a handle that are independently and separately operable to pivot the arm and thereby dispense the first fluid and the second fluid;

wherein the handle has a first end and an opposite second end and wherein the handle is pivotable into and between a rest position in which the first orifice and the second orifice are closed and an active position in which the first orifice and the second orifice are open, and further comprising:

a bearing plate along which the second end of the handle moves as the handle pivots, and wherein the bearing plate opposes pivoting of the handle toward the active position.

4. The beverage dispensing machine according claim 3, further comprising a plate receiver with an open end and an opposite closed end, and wherein as the handle pivots toward the active position the bearing plate moves toward the closed end of the plate receiver.

5. The beverage dispensing machine according claim 4, further comprising a biasing member disposed between the bearing plate and the closed end of the plate receiver so as to oppose movement of the bearing plate toward the closed end and thereby bias the handle toward the rest position.

6. The beverage dispensing machine according claim 5, wherein the biasing member is a spring that is compressed as the bearing plate moves toward the closed end, and wherein the spring applies a spring force to the bearing plate in a direction away from the closed end to thereby oppose movement of the bearing plate toward the closed end and bias the handle toward the rest position.

7. The beverage dispensing machine according to claim 6, wherein the bearing plate has a bore opposite a bearing surface, and wherein the spring has a first end that contacts the closed end of the plate receiver and a second end disposed in the bore of the bearing plate.

8. The beverage dispensing machine according claim 5, wherein the bearing plate has a bearing surface that is curved between a first end and an opposite second end, and wherein the spring force causes the bearing plate to cam the second end of the handle toward the first end of the bearing surface.

9. The beverage dispensing machine according claim 8, wherein the second end of the handle is curved to match the first end of the bearing surface, and wherein the second end of the handle is seated at the first end of the bearing surface when the handle is in the rest position.

10. The beverage dispensing machine according claim 9, wherein the bearing surface has a lip at the first end of the bearing surface to retain the second end of the handle on the bearing surface.

11. A beverage dispensing machine comprising:

a valve housing that defines a cavity;

a valve body disposed in the cavity and configured to receive a first fluid and a second fluid and dispense the first fluid through a first orifice and the second fluid through a second orifice;

a first valve seal movable to open and close the first orifice;

a second valve seal movable to open and close the second orifice;

an arm pivotally coupled to the valve body, wherein pivoting of the arm relative to the valve body moves the first valve seal and the second valve seal and thereby opens the first orifice and the second orifice;

a solenoid valve configured to pivot the arm;

a handle pivotally coupled to the valve housing, wherein the handle is pivotable relative to the valve housing into and between a rest position in which the valve seals are closed and an active position in which the valve seals are open, wherein as the handle pivots from the rest position toward the active position the handle acts on the solenoid valve such that the arm pivots and the valve seals gradually open, and wherein the handle has a first end and an opposite second end that extends into the cavity; and a bearing plate in the cavity along which the second end of the handle moves as the handle pivots, and wherein the bearing plate opposes pivoting of the handle toward the active position.

12. The beverage dispensing machine according claim 11, further comprising a plate receiver coupled to the valve housing and extending into the cavity;

wherein the plate receiver has an open end and an opposite closed end; and wherein as the handle pivots toward the active position the bearing plate moves toward the closed end of the plate receiver.

13. The beverage dispensing machine according claim 12, further comprising a biasing member disposed between the bearing plate and the closed end of the plate receiver so as to oppose movement of the bearing plate toward the closed end and thereby bias the handle toward the rest position.

14. The beverage dispensing machine according claim 13, wherein the biasing member is a spring that compresses as the bearing plate moves toward the closed end, and wherein the spring applies a spring force to the bearing plate in a direction away from the closed end to thereby oppose movement of the bearing plate toward the closed end and bias the handle toward the rest position.

15. A beverage dispensing valve comprising:

a valve body configured to receive a first fluid and a second fluid and dispense the first fluid through a first orifice and the second fluid through a second orifice;

a first valve seal movable to open and close the first orifice;

a second valve seal movable to open and close the second orifice;

an arm pivotally coupled to the valve body, wherein pivoting of the arm relative to the valve body moves the first valve seal and the second valve seal and thereby open the first orifice and the second orifice, and wherein the arm acts on the first valve seal before the arm acts on the second valve seal;

a first lever coupled to the first valve seal; and a second lever coupled to the second valve seal;

wherein as the arm pivots the arm actuates the first lever before the arm actuates the second lever; and wherein the arm has a first tab with a first thickness and a second tab with a second thickness less than the first thickness of the first tab, and wherein the first tab contacts the first lever before the second tab contacts the second lever.

16. The beverage dispensing valve according to claim 15, wherein the arm includes a first boss and an opposite second boss that extend in opposite directions along a pivot axis about which the arm pivots;

wherein the valve body has an opening corresponding to the first boss and the second boss in which the first boss and the second boss are received to thereby fix orientation of the pivot axis relative to the valve body.

17. A beverage dispensing machine comprising:

a valve body configured to receive a first fluid and a second fluid and dispense the first fluid through a first orifice and the second fluid through a second orifice;

a first valve seal movable to open and close the first orifice;

a second valve seal movable to open and close the second orifice;

an arm pivotally coupled to the valve body such that pivoting of the arm relative to the valve body moves the first valve seal and the second valve seal and thereby opens the first orifice and the second orifice; and a solenoid valve and a handle that are independently and separately operable to pivot the arm and thereby dispense the first fluid and the second fluid;

wherein the handle is operable into the different positions to thereby change flow rate of the first fluid through the first orifice and flow rate of the second fluid through the second orifice.

18. The beverage dispensing machine according to claim 17, wherein when the solenoid is operated, the flow rate of the first fluid through the first orifice is at a first maximum flow rate and the flow rate of the second fluid through the second orifice is a second maximum flow rate.

19. The beverage dispensing machine according to claim 18, wherein the handle is operable such that the flow rate of the first fluid through the first orifice is less than the first maximum flow rate and the flow rate of the second fluid through the second orifice is less than the second maximum flow rate.

* * * * *